US007526818B2

(12) United States Patent
Stinga et al.

(10) Patent No.: US 7,526,818 B2
(45) Date of Patent: May 5, 2009

(54) SPEAR SHIELD

(76) Inventors: Enrique F. Stinga, 12 Joey La., Avenel, NJ (US) 07001; Alexander Astudillo, 11102 SW. 129th Pl., Miami, FL (US) 33186

( * ) Notice: Subject to any disclaimer, the term of this patent is extended or adjusted under 35 U.S.C. 154(b) by 0 days.

(21) Appl. No.: 11/355,362

(22) Filed: Feb. 16, 2006

(65) Prior Publication Data

US 2006/0179555 A1 Aug. 17, 2006

(51) Int. Cl.
*A41D 13/00* (2006.01)

(52) U.S. Cl. ..... 2/267

(58) Field of Classification Search ..... 2/455, 2/267, 45, 94, 268, 95

See application file for complete search history.

(56) References Cited

U.S. PATENT DOCUMENTS 1,587,946 A * 6/1926 Gibson ..... 2/459
3,257,666 A * 6/1966 Hoffman ..... 2/459
4,353,133 A * 10/1982 Williams ..... 2/459
4,455,684 A * 6/1984 Johnson ..... 2/459
4,493,115 A * 1/1985 Maier et al. ..... 2/459
4,514,862 A * 5/1985 A'Costa ..... 2/459
5,629,673 A * 5/1997 Juhasz ..... 340/540
7,191,470 B2 * 3/2007 Benini ..... 2/69

* cited by examiner

*Primary Examiner*—Tejash Patel

(57) ABSTRACT

The aqua sport shield is used while spear fishing. The shield distributes the force of loading a spear gun over a body area such as a chest area or the thigh area of a person's leg, greater than the butt end of the spear gun. The shield is comprised of a waterproof layer, a force absorbing layer and a force distributing layer. The shield can be a separate unit and attached to the user or can be a releasable or permanent part of a wet suit. Further it can be of various shapes to fit different body shapes as long as it effectively distributes the force of loading the spear gun to prevent body bruising or undue comfort.

19 Claims, 5 Drawing Sheets

SPEAR SHIELD

This invention relates to a shield to protect a person who is using a spear gun from discomfort or injury. More particularly the shield protects a person from bruising the chest or thigh area of the leg during the process of arming a spear which uses elastic bands or a spring mechanism for firing a spear from a spear gun.

BACKGROUND OF THE INVENTION

In one type of spear gun the spear is spring loaded into the gun using, in one embodiment one or more elastic bands of different lengths and stretching resistance. A coiled spring also can be used. In order to spring load the spear on the gun a spring is compressed via a handle on the spear gun. In compressing the spring the butt end of the spear gun is braced against a person's chest. One or more elastic bands can be used in place of a spring. The butt of the spear gun is placed against a person's chest to stretch the bands to load a spear. In either situation the person's chest provides the support that absorbs the force of compressing the spring to launch the spear. After several spear loadings a person's chest can become bruised. The amount of bruising will depend to a degree on the particular spear gun, the spear, the strength/resistance of the spring or launching bands, the desired spear speed and the travel distance the user wants from the spear. The present objective is to provide a protective shield to prevent any bruising of a person's body during the act of loading a spear into a spear gun.

There are various body protector shields and garments used to protect law enforcement officers, athletes and workers in the construction industry. However, these shields and other protective garments are not suitable for use in spear fishing. In spear fishing the shield must be lightweight, have a cushioning effect, distribute a force over a portion of the chest area, and preferably be waterproof. In addition, it is advantageous that the shield be buoyant so that it can easily be retrieved in a submerged water environment without hindering the user while underwater. Also it can be easily retrieved if it falls overboard from a boat or falls from the grip of a person during its installation or use.

The prior art is replete with bullet-proof vests and other garments such as those disclosed in U.S. Pat. No. 5,072,453. U.S. Pat. No. 4,493,115 and U.S. Pat. No. 4,353,133 disclose shoulder protectors to protect against gun recoils. U.S. Pat. No. 5,742,947 and U.S. Pat. No. 6,145,134 disclose chest protectors for use in playing sports. U.S. Pat. No. 5,319,806 discloses a protective garment for construction workers. In the fishing area U.S. Pat. No. 5,551,184 discloses a fishing rod butt protector.

These are all interesting protective shields but do not set out any garment or shield to protect a person who is spear gun fishing. In particular there are no prior art shields or other garments to be used while spear fishing to protect the person during the loading of the spear fishing gun. This is the case whether the shield is for the chest area or for another part of the body, such as the thigh area of a leg.

BRIEF SUMMARY OF THE INVENTION

The invention is directed to a protective shield or garment to be used while spear gun fishing. The shield or garment distributes the force of loading a spear into the spear gun over a body area, such as the chest area or the thigh area of a leg, greater than the area of the butt of the spear gun. The shield or garment can be essentially of any shape to effect this result and comprised of an outer waterproof layer, a force distributing layer, and a force absorbing layer. This protective shield can be a separate shield unit worn by the person spear fishing or it can become an add-on part to a wet suit and including being an integral part of the wet suit. It can be attached to the user by adjustable straps, by hook and loop fasteners and equivalent devices or can be releasably or permanently attached to a user's wet suit. Preferably, it also is buoyant without interfering with use during spear fishing. This will preclude the shield being lost while in use or lost overboard from a boat.

DETAILED DESCRIPTION OF THE INVENTION

The invention will be described in more detail in its preferred embodiments with reference to the drawings. The concepts embodied in the invention are susceptible to various modifications all of which would be within the presently enclosed concepts.

Figure 1:
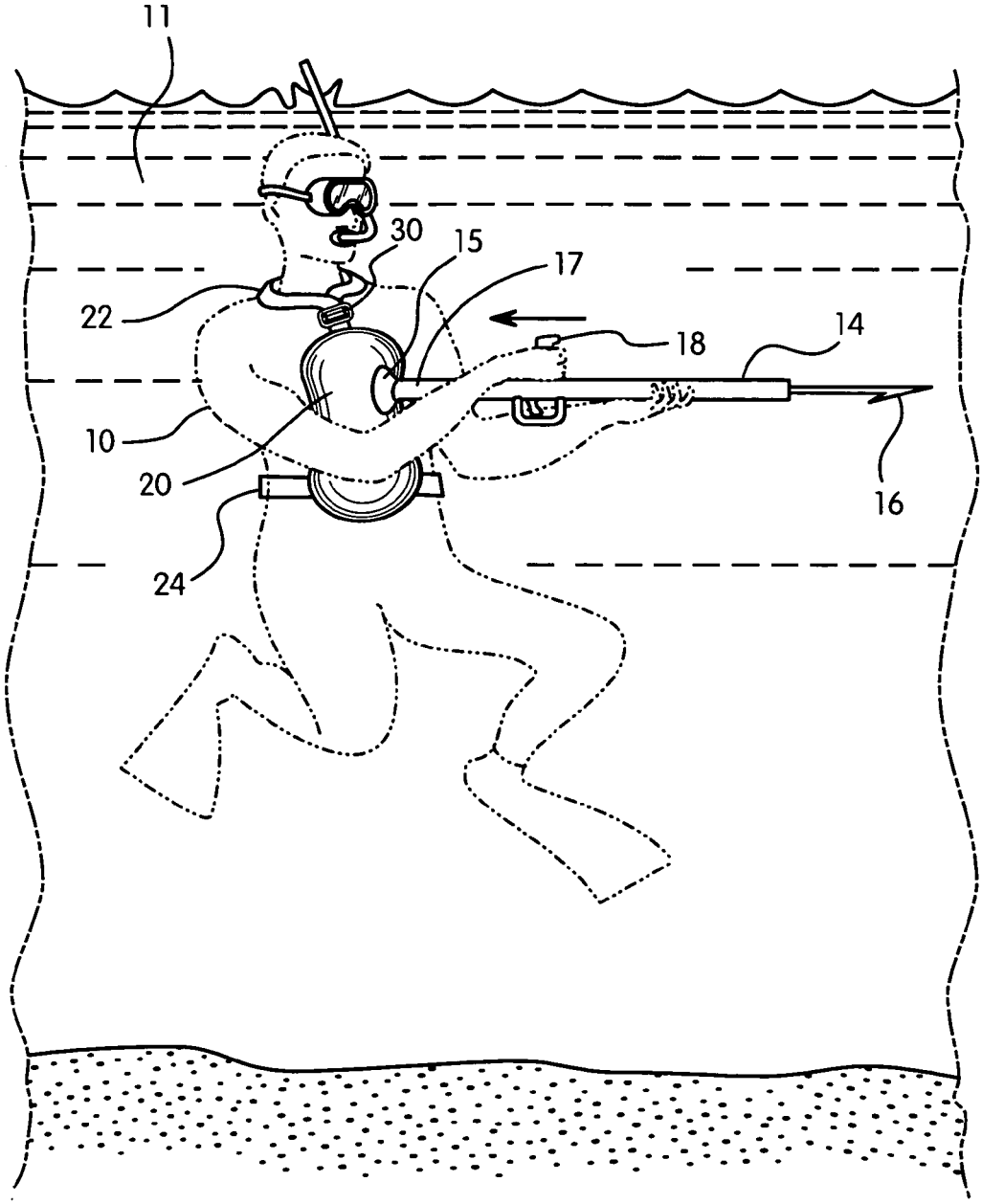
FIG. 1 is a descriptive view of the shield garment used by a person spear fishing.

FIG. 1 shows a person 10 under water 11 engaged in the sport of spear fishing. The person is shown for illustrative purposes as snorkeling. However in the sport of spear fishing the participants will in many instances use an air tank for breathing or lines from a compressor floating on the surface. The person 10 is holding spear gun 14 which holds a spear 16. The person is shown loading the gun by pulling back on handle 18 to compress a spring within the rear part 17 of the gun 14. The pulling back of the handle 18 (or pulling elastic bands) puts a compressing force on the butt end 15 of the spear gun. This force however is absorbed by the shield 20 which is shown as mounted on the person by neck strap 22 which has an adjustment buckle 30 and by waist strap 24 which can have a quick release buckle 26, 28. The waist strap 24 can have an adjustable buckle like that of buckle 30 on a back portion. Additionally the strap 24 can be an elastic strap to allow for body expansion and relaxation during breathing. However this shield 20 can be permanently adhesively attached to a wet suit worn by the person 10, attached using releasable adhesives, attached by a hook and loop fastener such as VELCRO fasteners, by threads, adjustment buckles similar to adjustment buckles 30 where one part is attached to a wet suit and the other part to the shield 20 and the parts attached by inserting one into the other, buttons, snaps zipper sewing or by some other equivalent attachment technique.

Figure 2:
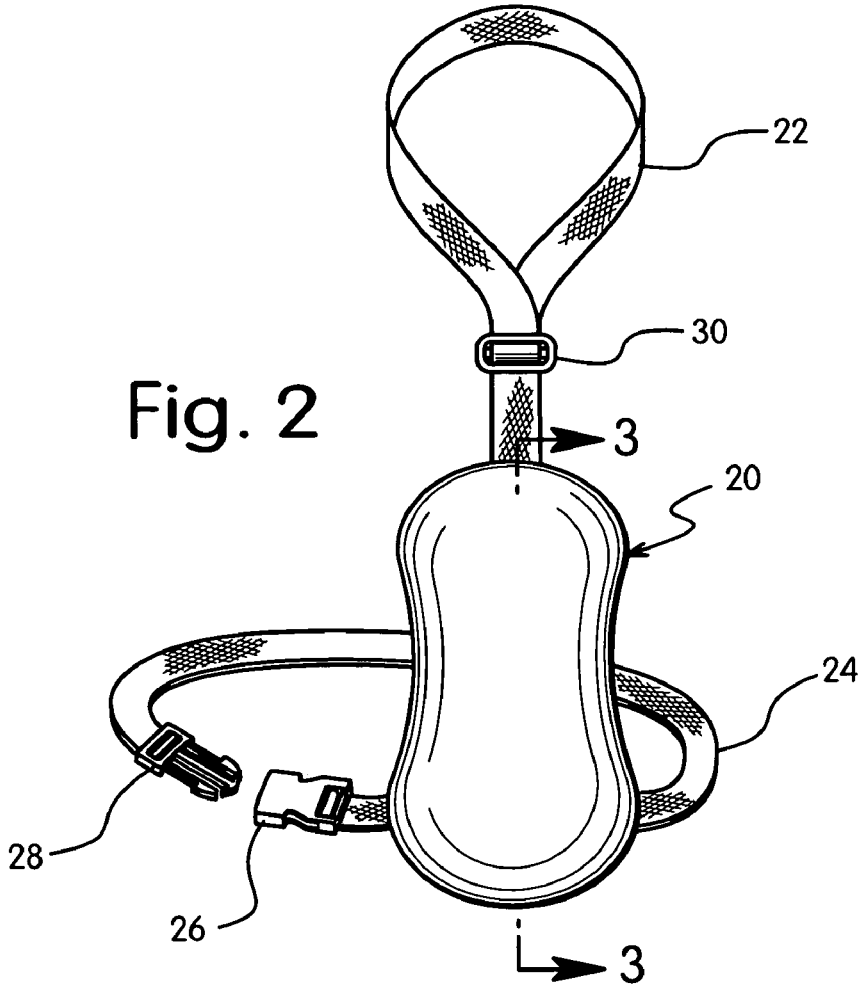
FIG. 2 is an elevated view of the protective shield.
Figure 3:
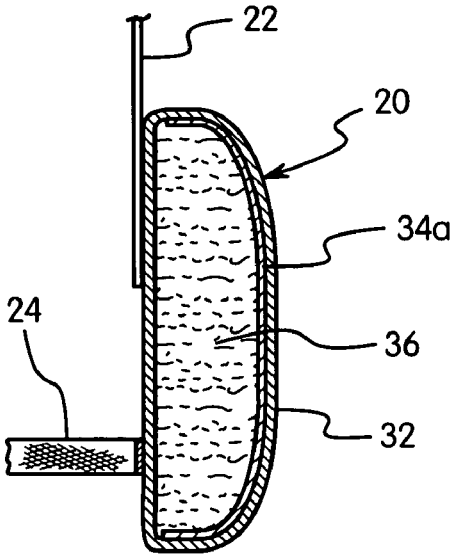
FIG. 3 is a cross-sectional view of the structure of the shield.
Figure 4:
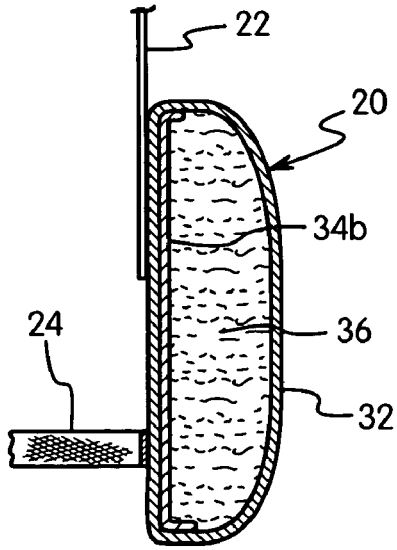
FIG. 4 is a cross-sectional view of an alternate embodiment for the structure of the shield.

The structure of the shield is shown in more detail in FIG. 2. This FIG. 2 shows the straps 22 and 24, including the buckle mechanism sections 26, 28 of strap 24. The buckle mechanism consists of inserting end 28 into receiver end 26. The inserting end is locked into the receiving end until it is manually released. Essentially any type of buckle can be used. However, a quick release type is preferred. FIG. 3 shows a structure of the shield in a cross-section view. There is a waterproof layer 32, a stiff layer 34(*a*) to distribute the force over a wider chest area and a soft cushion layer 36. The water proof layer 32 will have a thickness of about 0.5 mm to about 3 mm, and preferably about 1 mm to about 1.5 mm. The cushion layer 34 will have a thickness of about 5 mm to about 40 mm, and preferably about 10 mm to about 30 mm. The stiff later will have a thickness of about 1 mm to about 5 mm, and preferably about 1.5 mm to about 3 mm. In FIG. 4 it is shown that as an alternative the stiff layer 34(*b*) can be adjacent the user rather than adjacent the butt of the spear gun. In this embodiment the stiff layer will distribute the force of loading the spear gun over a larger body area.

The outer water proof film is resilient and puncture proof. Suitable film materials include polyvinyl chlorides, polyethylenes, polypropylenes, polyesters, polyamides such as nylons and laminates that include these film materials in different layers along with other film materials. This outer waterproof layer should also preferably have an anti-slip surface so that the butt of the spear gun will not slip on the shield while loading the spear gun. Thus the surface of this film material can be ribbed, mottled, dimpled, textured with a matte or other finish, or otherwise surface modified to increase the coefficient of friction of the surface with an object such as the butt of a gun.

The stiff layer 32 will be comprised of a plastic which can be reinforced with fibers such as glass, carbon, polyester, or nylon fibers. The plastics can be thermoset or thermoplastic plastics. Useful thermoset plastics include phenolics. Useful thermoplastics include polymers and copolymers comprised of ethylene and/or propylene and polyesters such as polyethylene terephthalate alone and in mixtures. The requirement is that the material be durable and that it distributes or absorbs the force from loading the spear gun over a chest area greater than the butt end area of the spear gun.

The cushion area 34 can be a resilient material that can absorb a force such that of loading a spear gun, and then regain it's original shape. Suitable materials are foam synthetics such as foam rubbers, polyurethanes, polystyrenes, and related materials. Naturally occurring sponges also can be used. This cushion area 34 can be in one or two molded sections or it can be a plurality of smaller pieces. In one embodiment it is preferred that this material be water proof of a closed cell foam material. In another embodiment it is preferred that it be open cell and absorb water. The straps can be of any commonly used strap material. However, it is preferred that they be of a mold/mildew resistant material. A suitable strap material is nylon braided strap material. The buckles can be of a durable polypropylene, nylon or another equivalent plastic.

The shield can be made to be bouyant, to have a neutral bouyancy or to have a negative bouyancy according to the type of diving such as free diving, scuba diving and the like. If bouyant, it will have a closed cell cushion area structure and the outer waterproof layer will fully enclose the cushion layer and preferably also the stiff layer. The objective is to keep water from the interior of the shield. In order to have a neutral bouyancy the outer waterproof layer can have apertures to permit some water to seep into the shield. The amount of water that will seep into the shield will be an amount needed to create neutral bouyancy. In this use the cushion material can fully or partially be an open cell structure and can incorporate inorganic fillers such as alumina, silica or titania to decrease the bouyancy of the shield. Sufficient water can flow into the shield to reach a neutral bouyancy. A negative bouyancy can be achieved by weights incorporated into the shield or by the combination of weights and the use of an open cell cushion material. In this embodiment the outer waterproof layer will have a plurality of apertures to allow water to flow into and out of the shield.

Further the cushion material of the shield can be replaceably maintained in the outer waterproof layer. The outer waterproof layer can have a conventional zipper, snap or a zip lock structure where a shaped projection fits into a mating shaped recess. In this way the cushion material can be replaced as needed and it will be easier to dry out the units that have a neutral or a negative bouyancy and apertures in the outer waterproof layer.

Figure 5:
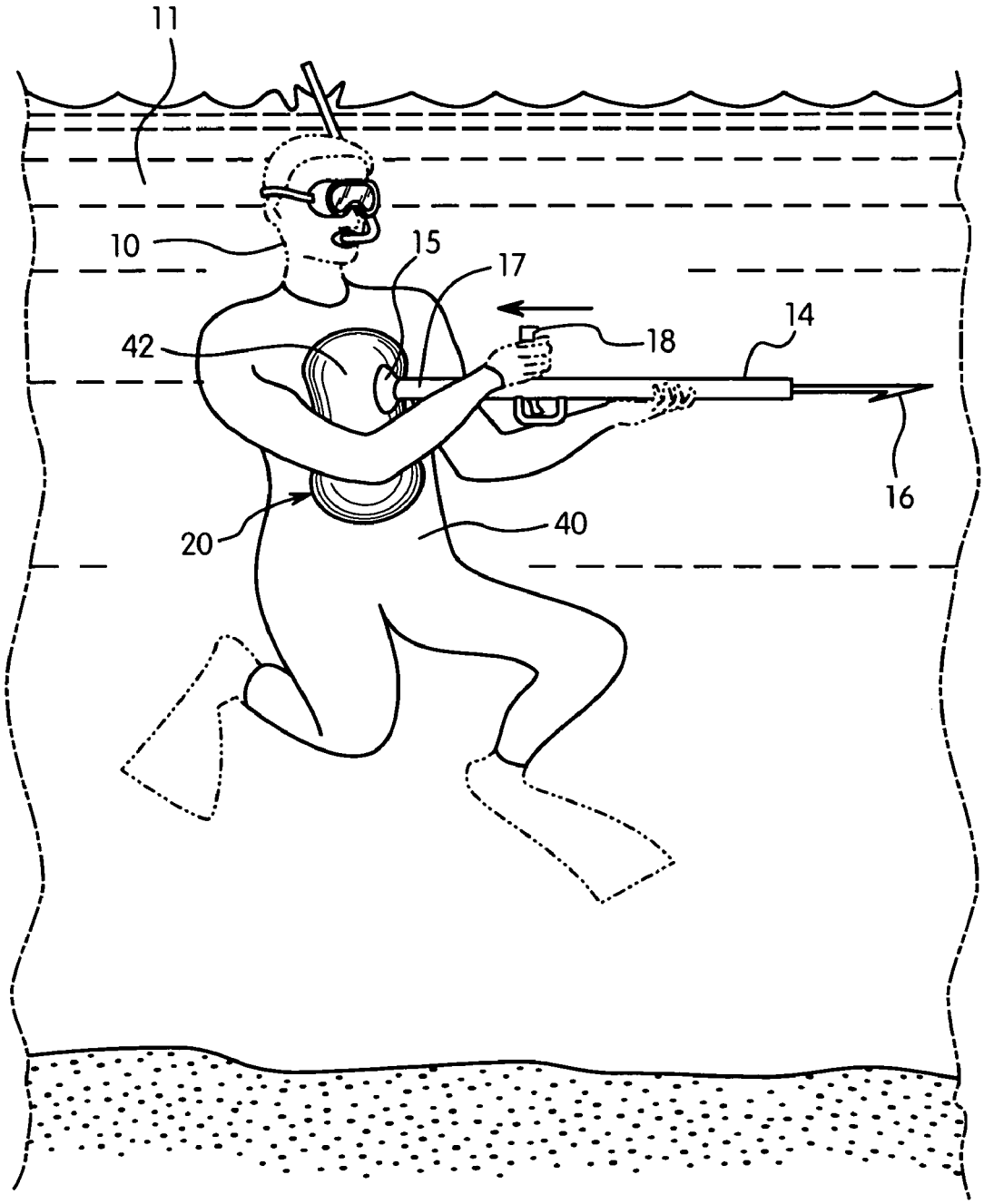
FIG. 5 is a view of the spear shield being an integral part of a wet suit.

In a further embodiment when a wet suit is to be used the shield can be an integral part of the wet suit. This is shown in FIG. 5 where shield cushion part 42 is a part of wet suit 40. The shield cushion part will have a layer 32 and a layer 34. The wet suit may form one side of waterproof layer 32 with an additional layer of wet suit material covering the exterior shield material surface. It is preferred to use as the shield material the same material as the wet suit since it is easier to bond similar materials together. The shield can be of various shapes to fit the contour of the bodies of different persons. For instance there will be a difference in the models for males and females due to the anatomical differences between males and females. However, the objective is the same. This is to distribute the force of loading a spear in a spear gun over a body area greater than the area of the butt of the spear gun, and preferably over a much greater area than the area of the butt of the gun.

Figure 6:
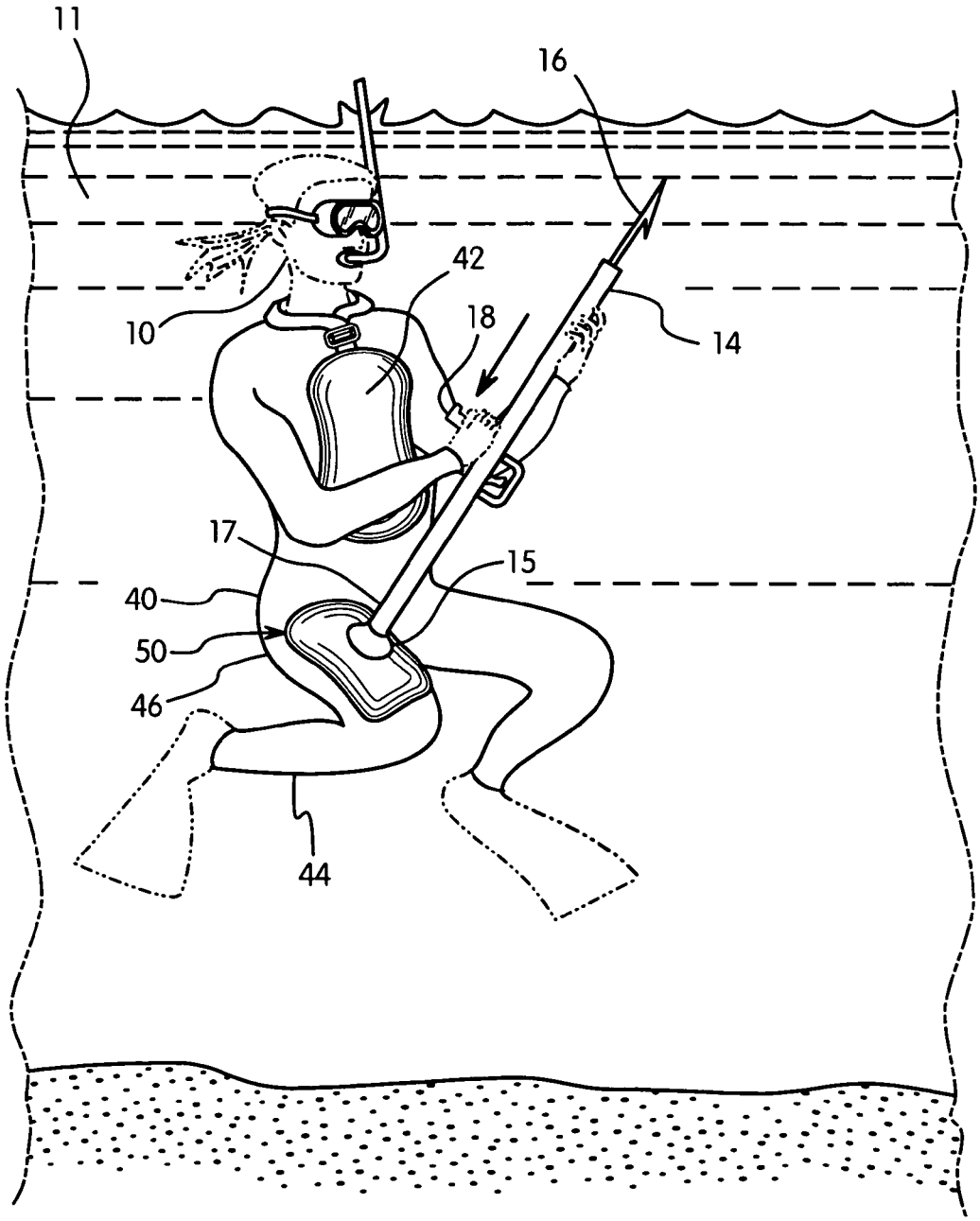
FIG. 6 is a view of the spear shield attached to the thigh area of a person's wet suit by a releasable or permanent technique.
Figure 7:
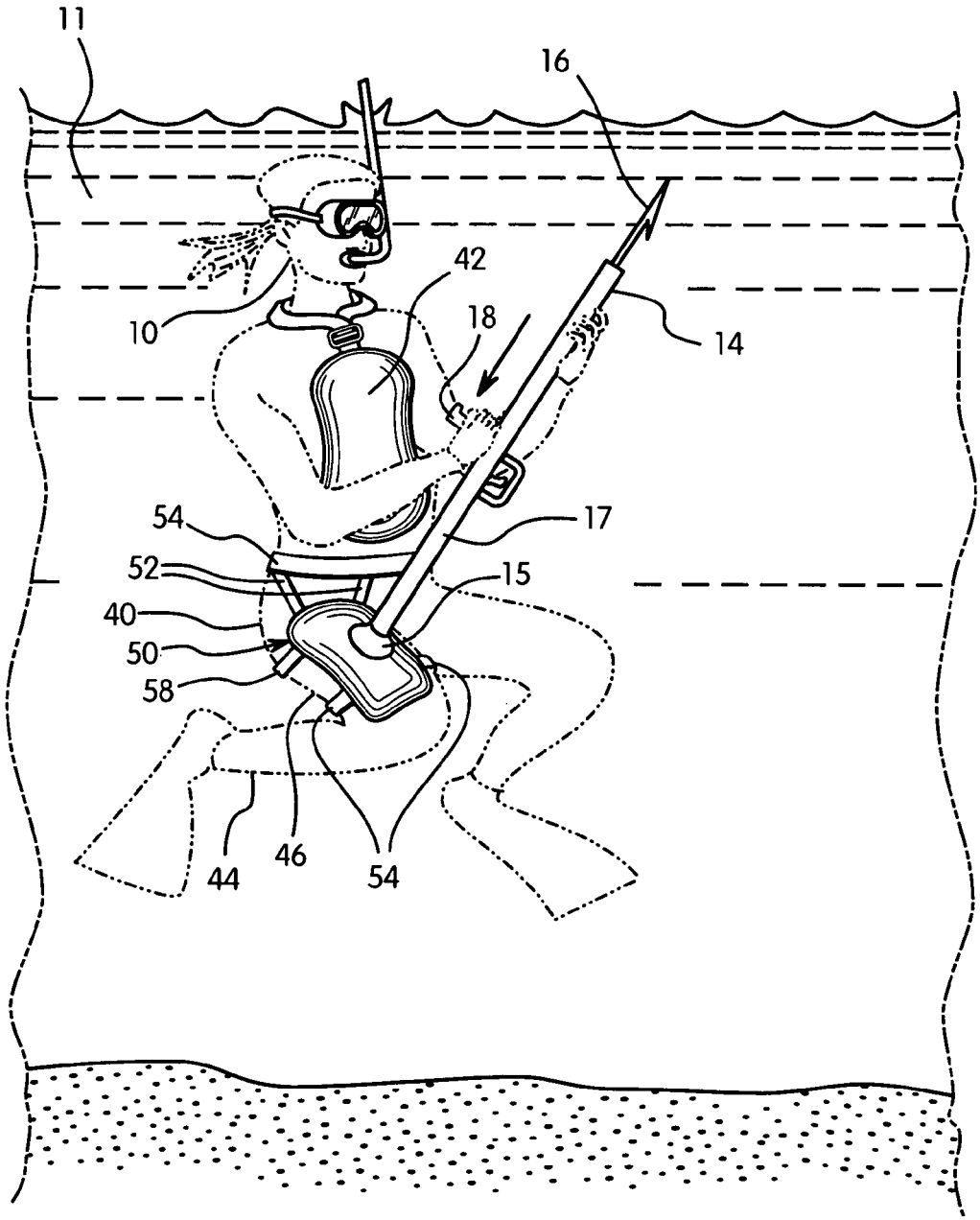
FIG. 7 is a view of a spear shield attached to the thigh area of a person's leg by straps.

FIGS. 6 and 7 show the shield attached to the thigh area of a persons leg. FIG. 6 shows diver 10 with the spear gun 10. A spear 16 is being loaded into the gun by pulling back on the handle 18. The diver is in water 11 and is shown with a snorkel. However, in many instances the diver will be using a tank of air that will be strapped to the back of the diver with a regulator and a face assembly to deliver the air to the diver. The diver 10 is shown wearing wet suit 40 with a chest shield 42. This chest shield can be of a type as shown and described in any of the prior Figures. That is it can be attached to the person by straps, attached to the body or wet suit by the prior described releasable techniques or permanently attached to the wet suit, such as being bonded to the wet suit. The bonding can be by means of adhesives or by heat bonding. Also shown is thigh shield 50 attached to the wet suit thigh area 46 of a person's leg 44. The butt end 15 of the spear gun 14 is braced against this shield 50 for the loading of the spear gun. Shown here are both the chest shield and the thigh shield. However, in use a person usually will use only one of the shields during a dive. FIG. 7 shows the same diver as in FIG. 6, but with the thigh shield attached to the diver's thigh area 46 by means of straps 52, 54 and 56. Shown here is a single strap 56 around the thigh 46 of the diver 10. However, it is useful to have a second strap 58 around the thigh. Strap 54 goes around the waist of the diver 10 with straps 52 extending from the strap 54 to the shield 50. Again here the diver 10 is shown with both a chest shield 42 and a thigh shield 50. However, for diving only one of the shields usually will be used.

The thigh shield will be constructed to about the same specifications as the chest shield, except for the shape and size. The shape will be for attachment to a thigh area in contrast to an attachment to a chest area. The thigh area shields have the advantage that the thigh and other upper leg muscles can be used in loading the spear gun. This is an advantage for a person with lower upper body strength. Additionally the leg muscles are stronger than the arm muscles in many people with the result that it will be easier for some divers to use the leg and thigh shield for loading the spear gun.

We claim:

1. A spear shield for use in spear fishing to be worn to distribute the forces of loading a spear into a spear gun over a body area of a person, the body area comprising at least one of the chest area of a person and the upper leg area of a person, the spear shield attached to the body of a person by at least one adjustable strap and comprising a shaped unit, said shaped unit including a force absorbing cushion layer, a force distributing stiff layer and a water proof cover, the water proof cover covering the cushion layer and the force distributing stiff layer; as to the force absorbing cushion layer and the force distributing stiff layer the cushion layer being adjacent the body area and the force distributing stiff layer covering the cushion layer opposite the body area and at least a portion of a side surface thereof the force distributing stiff layer being a stiff plastic whereby during the loading of a spear into a spear gun the butt of the spear gun is against the waterproof layer adjacent the force distributing stiff layer, the force distributing stiff layer distributing the loading force over a larger part of the cushion layer.

2. A spear shield as in claim 1 wherein the body area is the chest area of the person.

3. A spear shield as in claim 2 wherein the adjustable strap has a loop to attach the shield to a person's body.

4. A spear shield as in claim 3 wherein there is a neck strap.

5. A spear shield as in claim 1 wherein the force absorbing cushion layer has a thickness of about 5 mm to about 40 mm.

6. A spear shield as in claim 1 wherein the force distributing stiff layer is one of a thermoplastic or thermoset plastic and has a thickness of about 1 mm to about 5 mm.

7. A spear shield as in claim 1 wherein the waterproof cover has a thickness of about 0.5 mm to about 3 mm.

8. A spear shield as in claim 1 wherein the cushion layer has side surfaces, the stiff layer solely covers the surface of the force absorbing cushion layer opposite the surface adjacent to the body area and at least a portion of the side surfaces of the force absorbing cushion layer.

9. A spear shield as in claim 8 wherein the body area is the leg area of the person.

10. A shield as in claim 9 whereint he leg area of a person is the thigh of the person.

11. A spear shield as in claim 8 wherein the force distributing stiff layer is one of a thermoplastic or thermoset plastic and has a thickness of about 1 mm to about 5 mm.

12. A spear shield as in claim 8 wherein the force absorbing cushion layer has a thickness of about 5 mm to about 40 mm.

13. A spear shield as in claim 8 wherein the waterproof cover has an exterior surface with a coefficient of friction to prevent the butt of a spear gun from slipping on the shield during the loading of the spear gun.

14. A spear shield as in claim 13 wherein the waterproof cover has a non-slip exterior surface.

15. A spear shield as in claim 1 wherein the waterproof cover has an exterior surface with a coefficient of friction to prevent the butt of a spear gun from slipping on the shield during the loading of the spear gun.

16. A spear shield as in claim 1 wherein the force absorbing cushion layer is comprised of a closed cell foam material and is buoyant.

17. A spear shield as in claim 1 wherein the force absorbing cushion layer is comprised of an open cell foam material, the waterproof cover has apertures, and the shield is not buoyant.

18. A spear shield as in claim 1 wherein the waterproof has a plurality of apertures to allow water to pass there-through.

19. A spear shield as in claim 1 wherein the spear shield is buoyant.

* * * * *